US009016089B2

(12) United States Patent
Rydlewicz

(10) Patent No.: US 9,016,089 B2
(45) **Date of Patent: *Apr. 28, 2015**

(54) HEART SHAPED DIAMOND CUT AND METHOD HAVING HEARTS AND ARROWS PATTERN

(71) Applicant: Worldwide Diamond Trademarks Ltd., Vancouver (CA)

(72) Inventor: Roni Rydlewicz, Brussels (BE)

(73) Assignee: Worldwide Diamond Trademarks Ltd. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/740,857

(22) Filed: Jan. 14, 2013

(65) Prior Publication Data

US 2013/0125585 A1 May 23, 2013

Related U.S. Application Data

(63) Continuation-in-part of application No. 11/744,528, filed on May 4, 2007, now Pat. No. 8,353,181.

(51) Int. Cl.
*A44C 17/00* (2006.01)

(52) U.S. Cl.
CPC ..... *A44C 17/007* (2013.01); *A44C 17/001* (2013.01)

(58) Field of Classification Search
CPC ..... A44C 17/00
See application file for complete search history.

(56) References Cited

U.S. PATENT DOCUMENTS

| | | | | |
|---|---|---|---|---|
| D567,137 | S * | 4/2008 | Rydlewicz | D11/90 |
| 2003/0221452 | A1* | 12/2003 | Morbidoni | 63/26 |
| 2009/0269702 | A1* | 10/2009 | Garabedian et al. | 430/290 |

* cited by examiner

*Primary Examiner* — Jack W Lavinder
(74) *Attorney, Agent, or Firm* — Baker Hostetler LLP

(57) ABSTRACT

A heart shaped diamond possessing a hearts and arrows pattern characteristic comprising: eight main crown facets symmetrically aligned relative to one another, with each of the eight main crown facets having a straight edge in parallel alignment with a straight edge of another main crown facet disposed opposite thereto; eight main pavilion facets aligned at a fixed given angle of approximately 45° to each other and converging at a common point corresponding to the center of the diamond; sixteen pavilion half facets aligned at 22.5° with respect to each other, a girdle which is non-uniform and has a substantially unequal thickness throughout the diamond, a table facet, and a multiple number of crown star facets in an arrangement surrounding the table facet.

15 Claims, 5 Drawing Sheets

HEART SHAPED DIAMOND CUT AND METHOD HAVING HEARTS AND ARROWS PATTERN

The present invention is a continuation-in-part of application U.S. Ser. No. 11/744,528.

FIELD OF THE INVENTION

The present invention is a continuation application of U.S. Ser. No. 11/744,528 and more particularly relates to a heart shaped diamond having eight main crown facets for generating a hearts and arrows pattern characteristic when exposed to light comparable to the hearts and arrows pattern generated by an ideal round cut diamond.

BACKGROUND OF THE INVENTION

A hearts and arrows pattern is successfully generated from within a round cut diamond when exposed to light provided the round diamond was cut into a nearly perfect round shape possessing equal and symmetrically cut facets with its angular proportions satisfying relatively narrow ranges as taught below in Table I. The symmetry of a near perfect round cut diamond provides brilliance, color and optical light handling properties which, to date, no other shaped diamond has been able to match. Although diamonds are typically cut into many different geometrical shapes other than round such as, for example, a heart shape, oval, pear, marquis, princess, emerald, etc., only the round cut diamond has a nearly perfect symmetrical shape. For this reason, it was assumed, in the past, that a hearts and arrows pattern was a characteristic limited to the round shape and even then only when cut into a nearly perfect symmetrical shape with all facets of equal size and depth and cut at equal angle degrees. Contrary to conventional thinking the heart shaped diamond has a shape so irregular and non-round no one skilled in the art would have considered it possible to cut a heart shaped diamond and yield a hearts and arrows pattern when exposed to light.

In a round cut diamond the hearts and arrows pattern appears only when the requirements for its cut facets, angle parameters and alignment relationships are as shown in the following Table 1:

TABLE 1

| | |
|---|---|
| The shape of the diamond is perfectly symmetrical | |
| 8 main crown and 24 subsidiary crown facets | |
| 8 main bottom and 16 subsidiary bottom facets | |
| All main facets (crown & bottom) have to be polished at a perfect 45° angle to each other | |
| All facets are perfectly aligned | |
| All the bottom main facets are of equal size and at an angle ranging from 40.6°-41.0° | |
| All the bottom subsidiary facets are of equal size and at an angle which is exactly 1.2° steeper than the main facets (main bottom angle 40.6°-41.0° + subsidiary 41.8°-42.2°) | |
| All the main crown facets are of equal size and at an angle ranging from 33.8°-35.1°. They have to be perfectly aligned on the main bottom facets | |
| All the subsidiary crown facets are of equal size and perfectly aligned on the main crown and subsidiary bottom facets and polished at an equal angle | |
| The ideal cut proportions are: | total depth 59.4%-62.4% |
| | crown height 14.5%-16.0% |
| | girdle thickness 1.5%-2.95% |
| | Roundness 99.0%-100% |
| | Table size 53.0%-57.5% |

SUMMARY OF THE INVENTION

The heart shaped diamond, in accordance with the present invention, when exposed to light, displays a hearts and arrows pattern characteristic of the hearts and arrows pattern in a round diamond and comprises: eight main crown facets symmetrically aligned relative to one another, with each of the eight main crown facets having a straight edge in parallel alignment with a straight edge of another main crown facet disposed opposite thereto; eight main pavilion facets aligned at a fixed given angle of approximately 45° to each other and having a symmetrical number of pavilion half facets such that the eight main pavilion facets meet at a point corresponding to the symmetrical central of the diamond, a girdle and a table facet. The heart shaped diamond further comprises a multiple number of crown star facets spaced apart from one another on the surface of the diamond with each of the crown star facets being small in size relative to the size of the main crown facets. Another highly preferred attribute of the heart shaped diamond of the present invention is to have the pavilion half facets arranged in pairs with each pavilion half facet polished and aligned at a 22.5° angle from each adjacent pavilion half facet. It is further preferred that the crown halves be cut at an angle of between 3.8° and 4.6° steeper than the angle of the main crown facets and that the pavilion half facets should not exceed 3 of the length of the main pavilion facet measured from the common center of the diamond to the diamond girdle. Moreover, the distance between each of the pavilion half facets and the common point of the diamond should be identical.

BRIEF DESCRIPTION OF THE DRAWINGS

Other advantages will become apparent from the following detailed description of the invention when read in conjunction with the accompanying drawings of which:

FIG. 1B showing crown halves and crown stars, FIG. 1C showing the main pavilion facets, FIG. 1D showing multiple pavilion half facets polished on the main pavilion facets and FIG. 1E showing the butterfly effect on a traditional heart shaped diamond viewed from the table facet side;

DETAILED DESCRIPTION OF THE PREFERRED EMBODIMENT

Figure 1A:
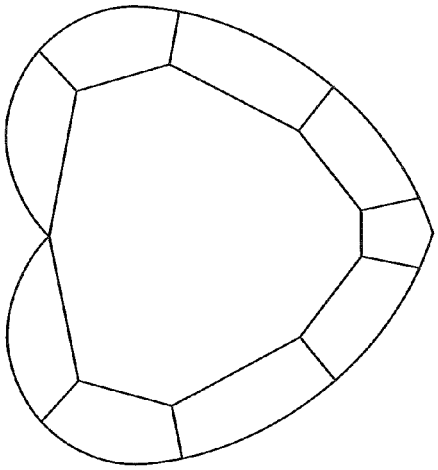
FIG. 1A (Prior Art)
FIG. 1A-1E are top views of the traditionally cut prior art heart shaped diamond with FIG. 1A showing the main crown facets.
Figure 1B:
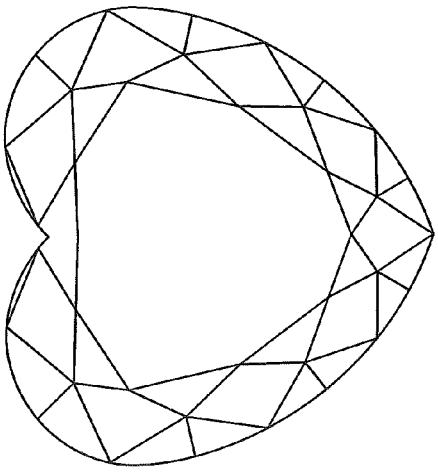
FIG. 1B (Prior Art)
Figure 1C:
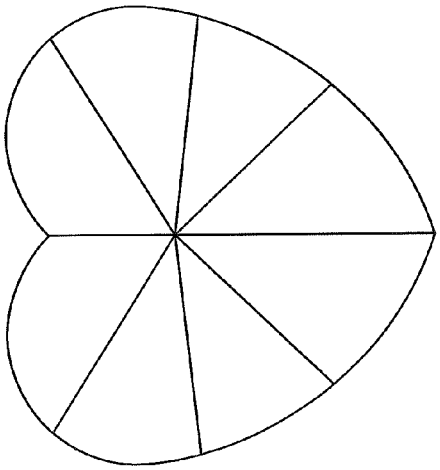
FIG. 1C (Prior Art)
Figure 1D:
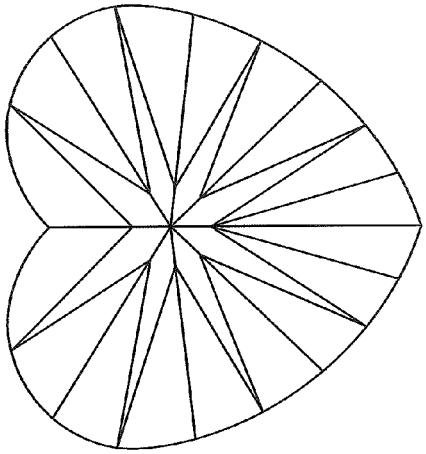
FIG. 1D (Prior Art)
Figure 1E:
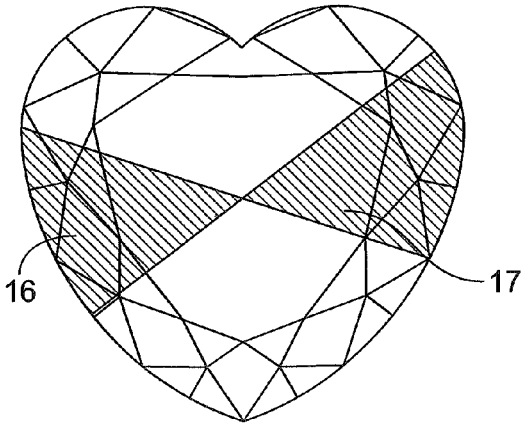
FIG. 1E (Prior Art)
Figure 2A:
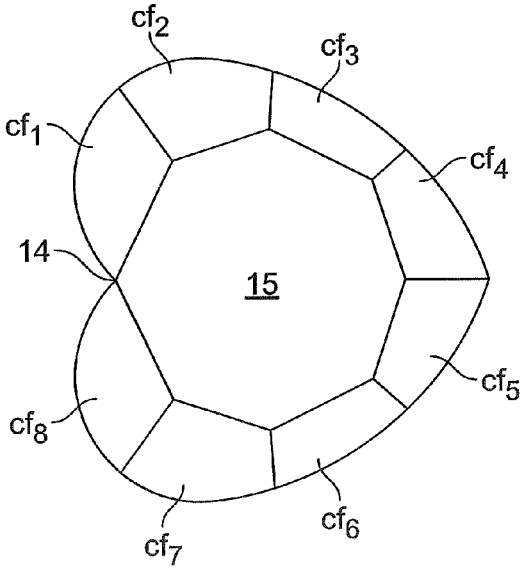
FIG. 2A-2E are top views of a heart shaped diamond of the subject invention at different stages of polishing with FIGS. 2A-2D comparative to FIGS. 1A-1D and with FIG. 2A showing the main crown facets, FIG. 2B showing crown halves and crown stars, FIG. 2C showing the main pavilion facets, FIG. 2D showing multiple pavilion half facets polished on the main pavilion facets and with FIG. 2E being an enlarged version of FIG. 2D.

A diamond is a crystal which functions as a prism for dispersing light by means of reflection and refraction. The traditional cut heart shaped diamond, identified as prior art, is shown in FIGS. 1A-1E respectively. Comparison views of the heart shaped cut diamond of the present invention is shown in FIGS. 2A-2E. It is customary for the traditional heart shaped diamond to include a subsidiary crown facet in the upper crown portion of the diamond as shown in FIG. 1A and a plurality of crown halves and crown stars as shown in FIG. 1B. The heart shaped cut diamond of the present invention as shown in FIG. 2A does not have any subsidiary crown facets in the upper crown portion of the diamond. Moreover in the traditional heart shaped the point of convergence of the pavilion facets (more typically referred to as the culet 1) as shown in FIG. 1C is not located at the center of the diamond but is offset therefrom whereas in the heart shaped cut diamond of the present invention as shown in FIGS. 2C-2E and FIG. 3 the point of convergence of the pavilion facets, i.e., the culet 11 is located at the center of the diamond. Moreover, in the traditional heart shaped diamond the girdle "g" is essentially equal in thickness throughout the diamond. The position, angle degree and alignment of the facets of the traditional heart shaped diamond are in line with the shape of the heart and are therefore not symmetrical in terms of positioning, alignment, size, angle degree and depth. The traditional heart shaped diamond has its facets polished ("cut") with different angle degrees to provide an off center culet and an equal girdle thickness throughout. This yields what is known in the diamond trade as a "butterfly effect", shown in FIG. 1E, such that when viewing the traditional heart shaped diamond in the presence of light through the table facet 15 on the side of the girdle "g" opposite the upper crown portion of the diamond one sees dark patches 16 and 17 in the left and right center area of the diamond.

A heart shaped diamond is traditionally constructed to satisfy the requirements in the following Table II:

TABLE II

| |
|---|
| 8 Main Pavilion facets aligned with the shape of the stone and, as such, they are asymmetrical and cause the angle degrees between all Main Pavilion facets to differ significantly |
| 18 Pavilion halves with differing angle degrees |
| 9 Main Crown facets that are not aligned on each other |
| 18 Crown halves with differing angle degrees |
| 9 Crown Star facets of differing angles, sizes and depths |
| The pavilion facets are cut within the angle degree range of 32°-38° |
| The crown facets are cut within the angle degree range of 30°-38.5° |
| The traditional heart-shaped diamond is cut with low (flat) crown and pavilion angle facets yielding a Total Depth between 52%-60%. |
| The curves of crown and pavilion facets are not polished parallel to the longitude axis of the stone, but are cut more towards the point to bring the shape of the table in agreement with the contour of the stone |
| The point of the diamond (culet) is not in the center of the stone. |

The heart shaped diamond of the present invention was developed to yield a hearts and arrows pattern by disregarding the asymmetrical shape of the heart and the presence of a groove 14 inherently formed between two main crown facets in a heart cut diamond. The heart shaped diamond of the subject invention is limited to eight main crown facets and eight main pavilion facets symmetrically aligned at a fixed given angle of approximately 45° to each other with a symmetrical number of pavilion half facets i.e., 16 polished perfectly symmetrical pavilion half facets on the 8 main pavilion facets with identical angle degree and height. In fact, the eight main pavilion facets should be symmetrically arranged so that they converge at a single point or culet 11 corresponding to the symmetrical central of the diamond as opposed to being off centered as in the traditional heart shaped diamond.

Figure 2B:
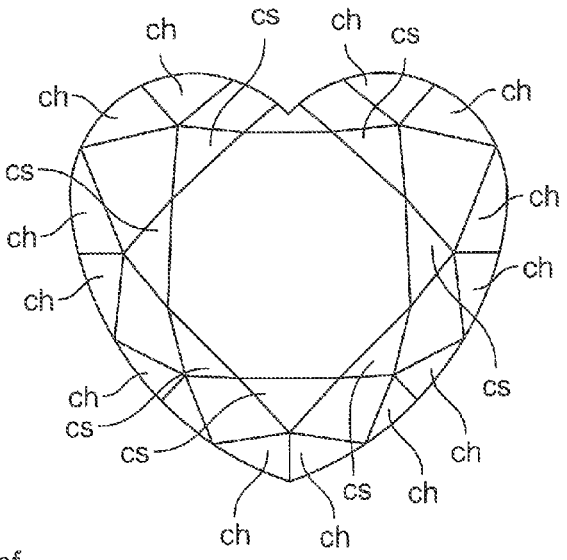
Figure 3:
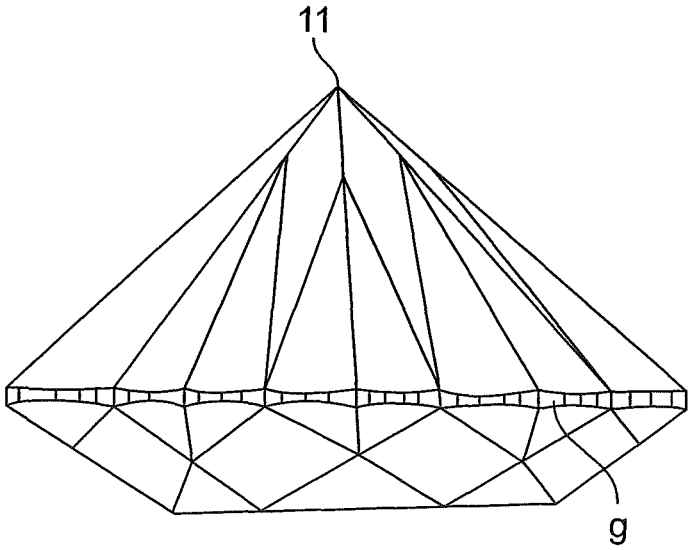
FIG. 3 is a side profile view of the heart shaped diamond of the subject invention.
Figure 4:
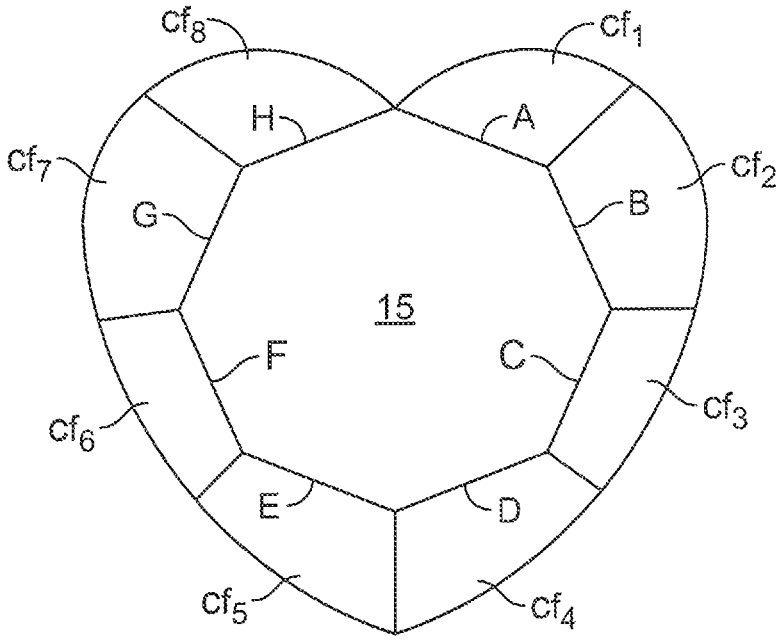
FIG. 4 is a comparative top view, similar to FIG. 2A, for demonstrating a major difference between the main crown facets in the heart shaped diamond of the subject invention as shown in FIG. 4 and the main crown facets of the traditional cut heart shaped diamond shown in FIG. 1A.

The heart shaped diamond of the subject invention is shown in the various top views FIGS. 2A-2E at different stages of polishing with FIG. 2A showing the upper crown portion comprising 8 main, crown facets ($cf_1$-$cf_8$), 8 main pavilion facets ($pf_1$-$pf_8$),), 16 pavilion half facets ($phf_i$-$phf_{16}$), and with FIG. 2B showing a plurality of crown halve facets, hereafter designated ("ch"), and a plurality of crown star facets, hereafter hereinafter designated ("cs"), respectively. FIG. 3 shows the girdle (g) and FIG. 4 shows table facet 15, which defines the top surface of the upper crown portion adjacent the eight main crown facets ($cf_1$-$cf_8$). The girdle (g) separates the upper crown portion from the pavilion facets and is unequal and non-uniform in thickness throughout the diamond. The girdle (g) should preferably have a centrally located belly area which is thicker than the thickness of the lower girdle area and thicker than the shoulder area causing the girdle thickness to vary throughout the diamond as is shown in FIG. 3.

It should be noted that in the heart shaped diamond of the present invention the crown star facets (cs) should preferably cover only 45% to 55% of the distance of the main crown facets as observed through the table side of the diamond.

Figure 2C:
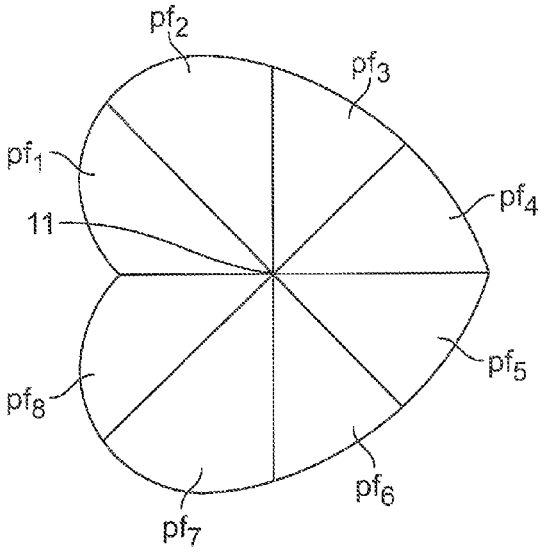
Figure 2D:
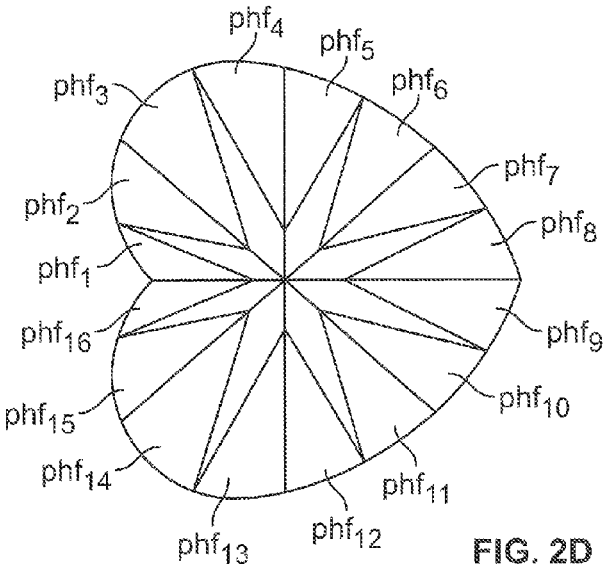
Figure 5:
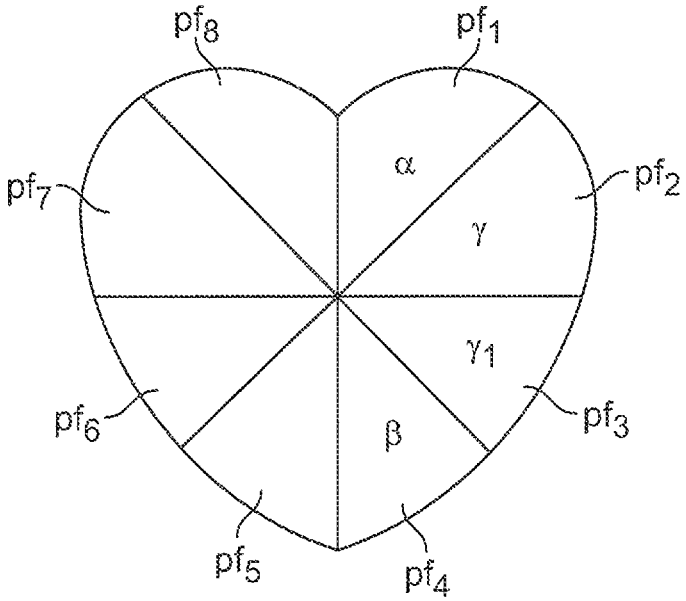
FIG. 5 is a comparative top view, similar to FIG. 2C, for demonstrating a major difference between the main pavilion facets in the heart shaped diamond of the subject invention as shown in FIG. 5 with the main pavilion facets of the traditional cut heart shaped diamond shown in FIG. 1C.

The main pavilion facets ($pf_1$-$pf_8$) are polished at exactly the same angle degree relative to the girdle (g) although the two main pavilion facets $pf_1$ and $pf_8$ are smaller in size because of their position opposite the groove of the heart as is shown in FIG. 2C and in FIG. 5.

Moreover, all of the pavilion half facets are equal in height and intersect the main pavilion facets at points such that the distance between the culet 11, corresponding to the symmetrical center of the diamond, and each of the intersecting points is essentially identical. The pavilion halves should preferably be approximately ¾ of the height of the main pavilion facets.

Figure 2E:
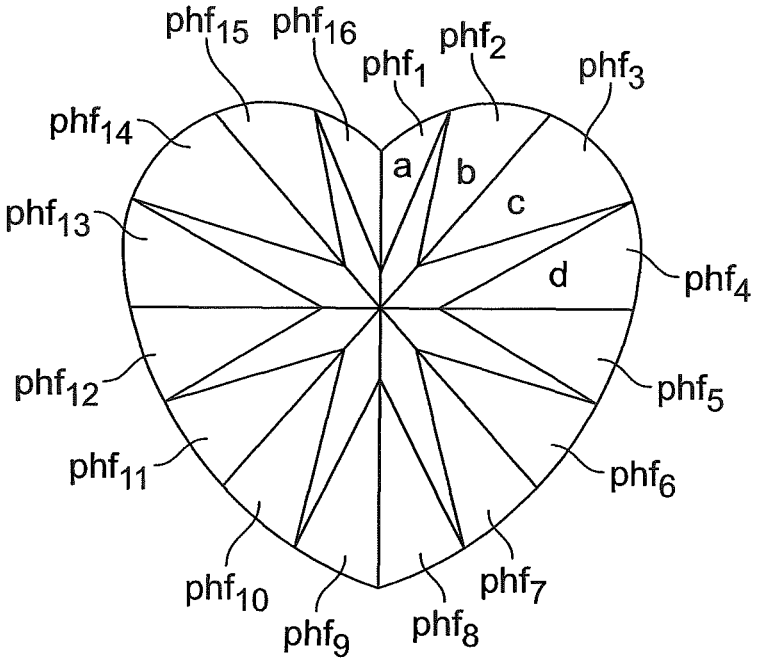

In addition, as is shown in FIG. 2E, the pavilion half facets ($phf_i$-$phf_{16}$) should be arranged in pairs having a first and second pavilion half facet, simply designated (a) and (b) in FIG. 2E, with each pair of pavilion half facets polished on a main pavilion facet such that pavilion half facet (a) is placed at 22.5° relative to pavilion half facet (b) in the same pair and with pavilion half facet (b) cut precisely relative to the next pavilion half facet (c) in an adjacent pair with which it shares a common boundary. Stated otherwise, the two pavilion half facets of each pair are placed on the same main pavilion facet and polished at the same angle degree relative to one another i.e., pavilion half facet (a) is placed at 22.5° relative to the pavilion half facet (b) in the same pair and pavilion half facet (b) is cut precisely relative to the next pavilion half facet (c) in an adjacent pair with which it shares a common boundary.

In the heart shaped diamond of the present invention, all of the eight main pavilion facets ($pf_1$-$pf_6$) are angularly aligned in a symmetrical relationship to one another as if in a circle at a fixed given angle of approximately 45° i.e. 360°/8=45° with each of the main pavilion facets cut, as explained above, at essentially the same angles where $\alpha=\gamma=\gamma_1=\beta$, as is shown in FIG. 5, and lie preferably between 40.5° and 41.2° thereby creating symmetry on an asymmetrical shape. This is in contrast to the traditional heart shaped diamond where corresponding main pavilion angles do not equal one another.

In addition, all of the eight main crown facets ($cf_1$-$cf_8$) of the heart shaped diamond of the present invention are not positioned in line with the shape of the diamond as is the case with conventional heart shaped diamond designs. Instead, the eight main crown facets ($cf_1$-$cf_8$) in the diamond of the subject invention are polished as is shown in FIG. 4 such that each of the main crown facets has a straight edge which lies parallel to a corresponding edge of another main crown facet disposed opposite thereto and with each main crown facet in parallel alignment with a corresponding main crown facet disposed opposite thereto and is consistent with the requirement set forth in Table III that "every main crown facet has a perfectly parallel opposite main crown facet".

FIG. 4 illustrates the arrangement of the eight main crown facets ($cf_1$-$cf_8$) relative to one another before the star facets and crown half facets are polished onto the main crown facets. Accordingly, as shown in FIG. 4 edge A of crown facet $cf_1$ is parallel to edge E of crown facet $cf_5$ which is in parallel alignment to the corresponding main crown facet $cf_1$. Similarly, edge B of crown facet $cf_2$ is parallel to edge F of crown facet $cf_6$ which is in parallel alignment to the corresponding main crown facet $cf_2$, edge C of crown facet $cf_3$ is parallel to edge G of crown facet $cf_7$ which is in parallel alignment to the corresponding main crown facet $cf_3$ and edge D of crown facet $cf_4$ is parallel to edge H of crown facet $cf_8$ which is in parallel alignment to the corresponding main crown facet $cf_4$. Upon polishing the star and crown facets onto the main crown facets the edges which otherwise would be adjacent the table facet disappear. Polishing of the star and crown half facets onto the main crown facets does not change the parallel alignment between opposite main crown facets. Accordingly, FIG. 4 continues to be representative of the parallel arrangement of opposing main crown facets in the polished diamond of the subject invention consistent with Table III in the description and FIG. 2B. This arrangement is in contrast to the traditional heart shaped diamond as is shown in FIG. 1A, which also represents a transitional figure comparable to FIG. 4, wherein the main crown facets are shown void of any star facets and crown half facets. In the traditional heart shaped diamond none of the main crown facets are polished to have an edge in parallel alignment with a corresponding edge of a main crown facet positioned opposite thereto and none of the main crown facets are in parallel alignment with a corresponding main crown facet disposed opposite thereto.

Moreover, in the heart shaped diamond of the present invention all of the pavilion halves are symmetrically polished on the main pavilion facets and at a preferred angle of between 40.5° and 41.2°. This is in contrast to the traditional heart shaped diamond where all of the pavilion halves are polished at different angle degrees. All of the preferred faceting and parameter requirements for the heart shaped diamond of the present invention are included in the following Table III:

TABLE III

| |
|---|
| 8 Main Pavilion facets, aligned with each other at a 45° angle, in order to create symmetry on an asymmetrical shape (360°/8 = 45°) |
| 8 Main Crown facets, aligned with each other and with the Main Pavilion facets |
| All main Pavilion facets have identical angle degrees (ranging from 40.5°-41.2°) |
| All main Pavilion facets have identical size and depth |
| Every Main Crown facet has a perfectly parallel opposite main crown facet |
| Each Main Pavilion facet has a perfectly parallel opposite main pavilion facet |
| Point of the diamond (culet) is near perfectly central, a maximum tolerance of 2% is allowed |
| Main Pavilion facets are all polished at an exact 45° from the neighboring main pavilion facets |
| Main Crown facets are all polished at an exact 45° angle from the neighboring main crown angles |
| Pavilion halves have to be of identical angle degree, size and height |
| Crown halves have to be polished at an angle degree of 3.8°-4.6° steeper than the main crown facets |
| Pavilion halves should not exceed ¾ of the length of the main pavilion facet |
| Crown Star facets should cover only 45%-55% of the distance of the Main Crown facets as observed through the table |
| The main pavilion facets are perfectly aligned with the main crown facets |
| Two Pavilion halves facets are polished on each Main Pavilion facet with each pavilion half facet polished at precisely 22.5° from one another |

TABLE III-continued

| |
|---|
| The Pavilion halve facets should between 66%-82% of the distance of the Main Crown facets as measured from the girdle facet to the culet point 11 where the main pavilion facets meet. |

Parameters to Achieve Optimum H&A Pattern on a Heart-Shaped Diamond:

| | |
|---|---|
| Total Depth | 59.5%-64.3% |
| Pavilion Depth | 43.6%-46.2% |
| Main Pavilion Angle | 40.55°-41.2° |
| Crown Depth | 14.5%-16.2% |
| Main Crown Angle | 33.6°-35.2° |
| Table Size | 53.5%-57.8% |
| Position of Culet (point of the diamond) must be nearly central: the tolerance should be less than 2% | |
| Crown Halves: 3.8°-4.6° steeper than main crown angle | |
| Crown Stars: 14.4°-17.8° flatter than main crown angle | |

What is claimed is:

1. A heart shaped diamond of non-round shape which when exposed to light displays a hearts and arrows pattern substantially equivalent to the hearts and arrows pattern in a round diamond comprising: an even number of main crown facets with all of the main crown facets symmetrically aligned and polished to form essentially identical angles based upon dividing 360° by the number of main crown facets so that the main crown facets are symmetrically arranged around the non-round shape with each of the main crown facets in parallel alignment with a corresponding main crown facet disposed opposite thereto; a corresponding equal number of main pavilion facets; an even number of pavilion half facets such that the main pavilion facets meet at a common point corresponding to the symmetrical center of the diamond, a plurality of crown half facets, a girdle which is non-uniform and has a substantially unequal thickness throughout the diamond, a table facet, and a multiple number of crown star facets in an arrangement surrounding the table facet.

2. A heart shaped diamond as defined in claim 1 wherein each of the crown star facets are small in size relative to the size of the main crown facets.

3. A heart shaped diamond as defined in claim 2 wherein the crown star facets cover only 45% to 55% of the distance of the main crown facets as observed through the table side of the diamond.

4. A heart shaped diamond as defined in claim 3 wherein the eight main pavilion facets are aligned at a fixed angle to each other with a tolerance of 2% or less.

5. A heart shaped diamond as defined in claim 4 wherein the multiple number of crown star facets surrounding the table facet are arranged such that they contact one another without exposing adjacent main crown facets to the table facet.

6. A heart shaped diamond as defined in claim 1 wherein the even number of main crown facets consists of eight main crown facets and the corresponding equal number of main pavilion facets consists of eight main pavilion facets.

7. A heart shaped diamond as defined in claim 6 further comprising sixteen pavilion half facets wherein each pavilion half facet is aligned at 22.5° to each other and intersects a main pavilion facet at a point which equals in distance the distance between the cutlet, corresponding to approximately the symmetrical center of the diamond, and each such point.

8. A heart shaped diamond as defined in claim 7 wherein each of the main pavilion facets are aligned at a fixed given angle of approximately 45° to each other and with each of the main pavilion facets cut at between 40.5° and 41.2°.

9. A heart shaped diamond as defined in claim 8 wherein the crown halves are cut at an angle of between 3.8° and 4.6° steeper than the angle of the main crown facets.

10. A heart shaped diamond as defined in claim 7 wherein the pavilion half facets have a length equal to or smaller than ¾ of the length of the main pavilion facet measured from the common center of the diamond to the diamond girdle.

11. A method for polishing a diamond into a heart shaped diamond of non-round shape which when exposed to light will display a hearts and arrows pattern characteristic substantially equivalent to the hearts and arrows pattern in a round diamond with the diamond comprising a table facet, an even number of main crown facets, a corresponding equal number of main pavilion facets, a symmetrical number of pavilion half facets, a multiple number of crown star facets, a plurality of crown half facets and a girdle which is non-uniform and has a substantially unequal thickness throughout the diamond, the method comprising the steps of: polishing the main crown facets at essentially an identical angle relative to one another so that the main crown facets are symmetrically arranged around the non-round shape of the heart shaped diamond with each of the main crown facets in parallel alignment with a corresponding main crown facet disposed opposite thereto; polishing the crown star facets and the crown half facets onto the main crown facets in an arrangement which symmetrically surround the table facet; and polishing the main pavilion facets such that the main pavilion facets meet at a common point corresponding to approximately the center of the diamond.

12. A method as defined in claim 11 wherein the even number of main crown facets consists of eight main crown facets and the corresponding equal number of main pavilion facets consists of eight main pavilion facets.

13. A method as defined in claim 12 wherein the multiple number of crown star facets are arranged such that they contact one another without exposing adjacent main crown facets to the table facet.

14. A method as defined in claim 13 wherein the eight main pavilion facets are aligned at a fixed angle to each other and with each main pavilion facet having a parallel opposite main pavilion facet with a tolerance of 2% or less.

15. A method as defined in claim 14 wherein the eight main pavilion facets are aligned at a fixed given angle of 45° to each other with 16 perfectly symmetrical pavilion half facets polished onto the 8 main pavilion facets and arranged to converge at a single point corresponding to the symmetrical center of the diamond.

* * * * *